United States Patent [19]

Joyce

[11] 4,128,172

[45] Dec. 5, 1978

[54] HOLDER FOR SHAVING UNITS

[75] Inventor: Michael F. Joyce, Reading, England

[73] Assignee: The Gillette Company, Boston, Mass.

[21] Appl. No.: 836,792

[22] Filed: Sep. 26, 1977

[30] Foreign Application Priority Data

Sep. 28, 1976 [GB] United Kingdom ..... 40093/76
Mar. 22, 1977 [GB] United Kingdom ..... 12105/77

[51] Int. Cl.[2] ..... B65D 85/54
[52] U.S. Cl. ..... 206/352; 206/354; 206/356; 206/493
[58] Field of Search ..... 30/40, 40.2; 206/228, 206/352, 354–356, 378, 443, 477, 482, 493

[56] References Cited

U.S. PATENT DOCUMENTS

| | | | |
|---|---|---|---|
| 1,712,473 | 5/1929 | McWethy | 206/378 |
| 2,344,962 | 3/1944 | Benjamin | 206/356 |
| 2,598,492 | 5/1952 | Boes | 206/482 X |
| 3,785,051 | 1/1974 | Dawidowicz et al. | 206/356 X |
| 4,047,295 | 9/1977 | Francis | 206/356 X |

*Primary Examiner*—Steven E. Lipman
*Attorney, Agent, or Firm*—Richard A. Wise; Scott R. Foster

[57] ABSTRACT

A dispenser and a shaving unit, the shaving unit having a slide coupling thereon for attachment to a razor handle, the dispenser comprising a base portion, and an elongated tongue extending outwardly from the base portion, the tongue being adapted to releasably retain the shaving unit thereon by frictional engagement of the tongue with the slide coupling of the shaving unit.

9 Claims, 4 Drawing Figures

HOLDER FOR SHAVING UNITS

BACKGROUND OF THE INVENTION

1. Field of the Invention

This invention relates to holders and dispensers for shaving units and is directed more particularly to such a device for shaving units having slide coupling means thereon for attachment to a razor handle.

2. Description of the Prior Art

Devices for holding and dispensing shaving units having slide coupling means thereon for attachment to a razor handle are generally known in the art. For example, U.S. Pat. No. 3,835,532, issued Sept. 17, 1974, in the name of R. J. Petrillo, shows a package for retaining a plurality of shaving units and for facilitating interconnection of slide coupling means on the shaving units with slide connection means of a razor handle.

SUMMARY OF THE INVENTION

An object of the present invention is to provide a novel holder and dispenser for shaving units of the type having a slide coupling means for interconnection with a razor handle.

A further object of the invention is to provide such a device as is relatively non-complex and therefore economical to manufacture.

A still further object of the invention is to provide such a device as is easy, safe and reliable to use.

With the above and other objects in view, as will hereinafter appear, a feature of the present invention is the provision of a dispenser for shaving units having slide coupling means thereon for attachment to a razor handle, the dispenser comprising a base portion, and elongated tongue means extending outwardly from the base portion, the tongue means being adapted to releasably retain a shaving unit thereon by frictional engagement of the tongue means with the slide coupling means of the shaving unit.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENTS

Figure 1:
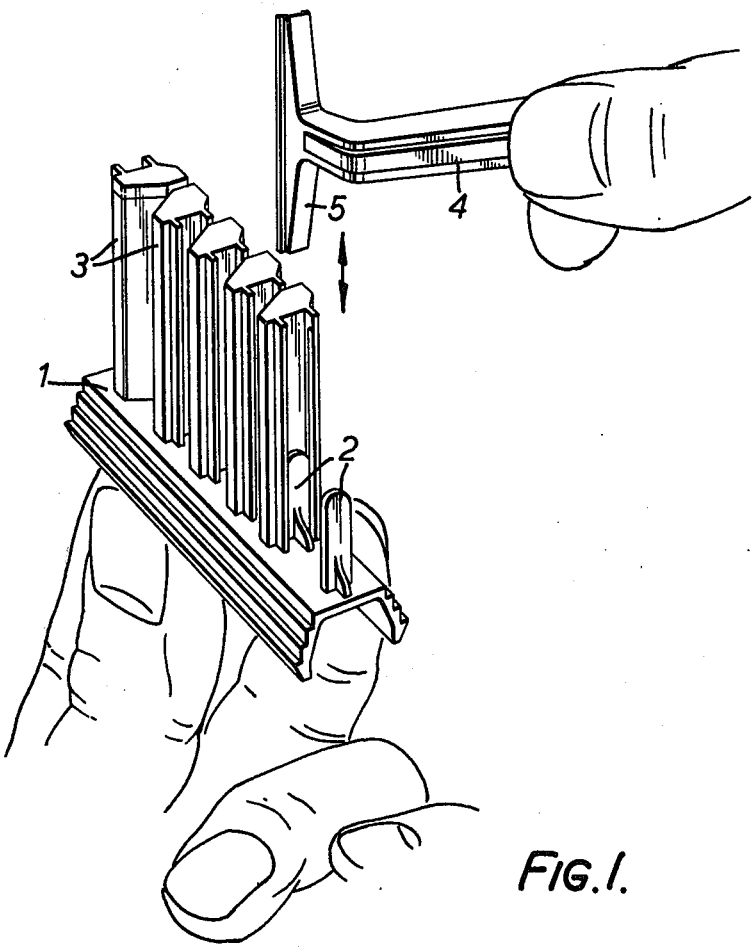
FIG. 1 is a perspective view of a dispenser for shaving units illustrative of an embodiment of the invention, and, further, illustrative of the use of the device.

Referring to the drawings, it will be seen that a preferred embodiment includes a unitary injection molding shaped to have an elongated base portion 1 and a plurality of upstanding elongated tongues 2 fast at their lower ends to the base portion, and extending away from the base portion, and parallel with each other. The cross section of each tongue 2 is suited to fit closely within slide connection structures of shaving units 3 mounted on the tongues. An unoccupied tongue may be provided to receive a discarded shaving unit, if desired. The length of each tongue is about one-third of that of the shaving unit.

The shaving units shown are of the type described in U.S. Pat. Nos. 3,703,764; 3,724,070, 3,768,162 and 3,786,563. The tongues 2 make firm frictional engagement in the slide coupling structures of the shaving units 3 to retain the shaving units sufficiently firm for storage and transit. Means other than simple frictional restraint may be employed to retain the shaving units on their tongues, such as snap-fitting connection means or releasable locking means (not shown).

Preferably, and as shown in FIG. 1, the units 3 are so oriented on the tongues 2 that the outermost units in the row have their coupling slide structure turned towards the adjacent end of the row, so that the cutting edges of their blades are turned towards, and shielded by the adjacent shaving units.

In use, the user may hold the dispenser by its base portion in his left hand, and a cooperating razor handle 4 in his right hand, inserting the slide connection portion 5 of the razor handle into the uppermost unoccupied portion of the slide coupling structure of the endmost shaving unit. By virtue of the greater frictional retention of the handle with the shaving unit, the latter may then be pulled, by the handle, off its tongue, and pushed by hand into its final operative position on the razor handle.

If desired, a used shaving unit to be discarded can be transferred from the razor handle onto a vacant tongue.

Figure 2:
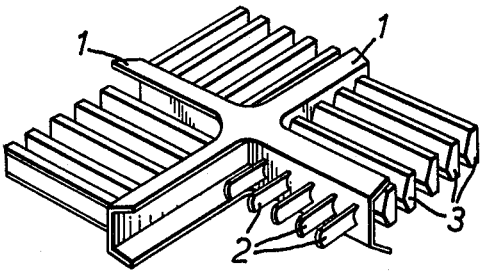
FIG. 2 is a perspective view of an alternative embodiment.

The modified dispenser of FIG. 2 effectively comprises a group of four base portions, each with its own tongues, integrally connected by their ends to form a cruciform structure. In this case, the shaving units preferably have their blade members turned towards the inner end of each base portion, the innermost unit being shielded by the adjacent base portion.

Figure 3:
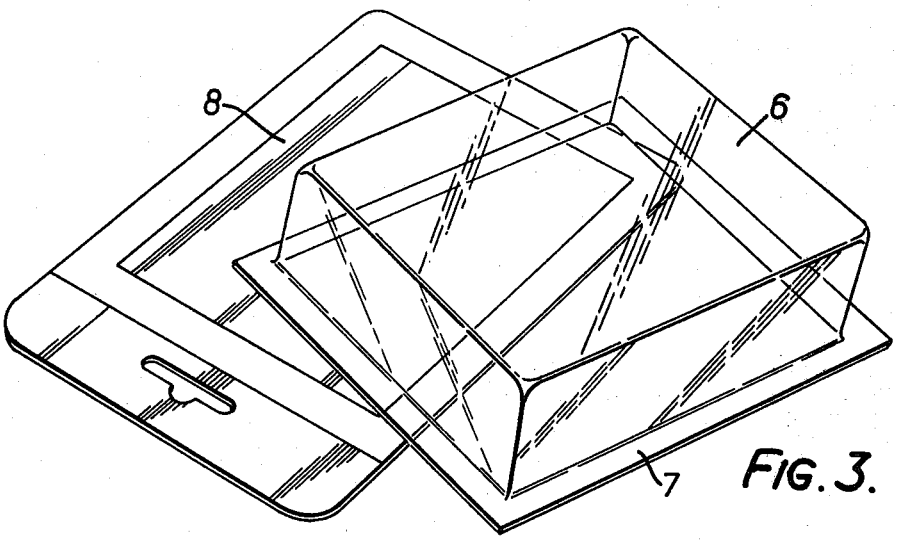
FIG. 3 is a perspective view of illustrative packaging for use in conjunction with the present invention.

Either form of dispenser is conveniently packed in a blister pack of the form shown in FIG. 3, in which a transparent blister part 6 has a continuous peripheral flange 7 secured to a base-board 8, the pack being designed for complete separation of the blister from the base-board for removal of the dispenser.

Figure 4:
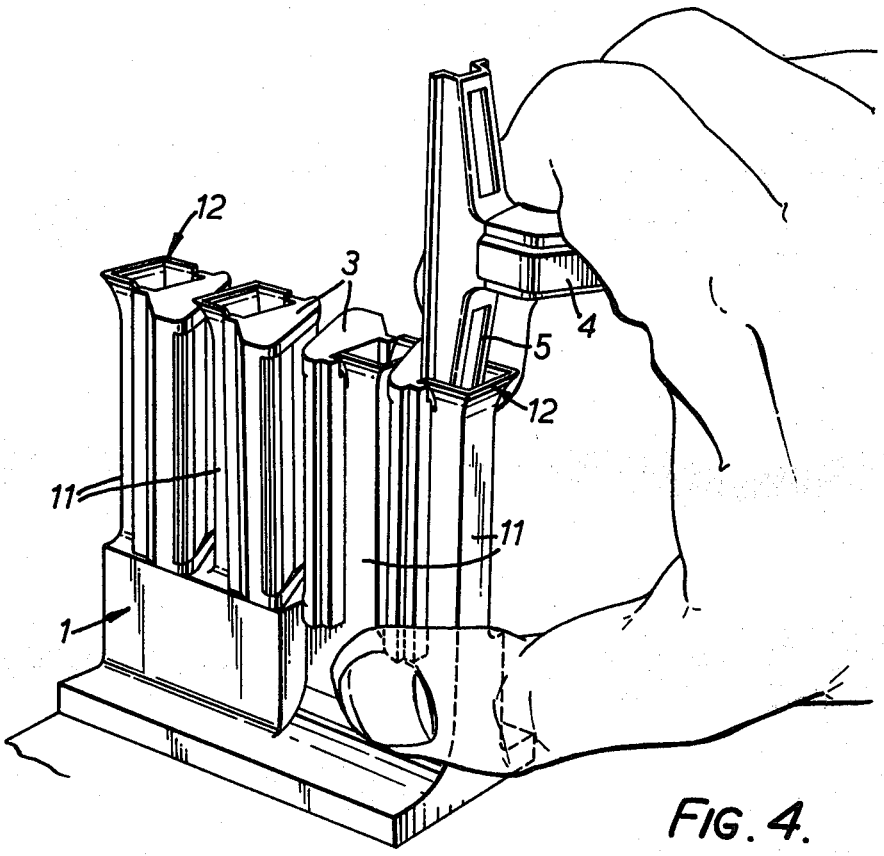
FIG. 4 is a perspective view of an alternative embodiment of dispenser, and further, illustrative of the use of such alternative embodiment.

In the modified form of dispenser shown in FIG. 4, the tongues (hidden from view) each have associated with them a shroud 11 whose upper end is flared, as at 12, to provide a "lead-in" section. The shaving units 3 are stored on the tongues and the base portion 1 is relieved locally at one side beneath each shaving unit to permit access of the thumb to the shaving unit as shown in FIG. 4. In this case, four units are shown, all arranged to have their coupling slide structures disposed nearer the adjacent end of the dispenser, so that two face one way and two face the other way, and the base portion 1 is relieved beneath the rear edges of each pair of units (i.e. the edges further from the blade edges). The tongues in this case extend substantially the full length of the shaving unit slide coupling structures.

The manner of use will be readily understood from FIG. 4. The razor handle 4, being held in the right hand of the user, is manipulated to bring one end of the slide 5 of the handle into the flared portion 12 of the shroud 11, which guides the slide 5 into register with the upper end of the shaving unit slide structure. The thumb is then engaged under the shaving unit and pushes it upwardly, off the tongue and onto the slide 5.

The cutting edges of the units on the dispenser are protected, either by the adjacent shroud or by an adjacent unit, for transit and storage. The guidance afforded by the shroud eases the loading of the shaving units onto the handle, particularly for users whose eyesight is poor.

It is, of course, necessary for the shaving units to be correctly oriented on the handle and correct orientation is encouraged by the positioning of the shaving units on the dispenser and the asymmetric shaping of the dispenser itself, which virtually assures correct use by a right-handed person and encourages it for a left-handed person.

Many variations and modifications will be possible within the scope of the invention. For example, the dispenser shown in FIG. 4 could form part of a multiple dispenser of the form shown in FIG. 2.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A dispenser and a shaving unit, said shaving unit having slide coupling means thereon for attachment to a razor handle, said slide coupling means comprising a pair of opposed grooves, said dispenser comprising a base portion, and elongated tongue means extending outwardly from a first surface of said base portion, said tongue means and said shaving unit being substantially normal to said base portion, said tongue means having a first end free and a second end fixed to said base portion and having parallel edges slidingly engaging said grooves, thereby releasably retaining said shaving unit thereon by frictional engagement of said tongue means edges with said grooves of said slide coupling means of said shaving unit.

2. The invention in accordance with claim 1 in which said base portion and said tongue means comprise a unitary molding of synthetic plastic material.

3. The invention in accordance with claim 1 in which said tongue means is of a length less than the length of said slide coupling means of said shaving unit.

4. The invention in accordance with claim 1 in which said base portion is provided with relieved portions to permit manual manipulation of one end of a shaving unit disposed on said tongue means, whereby said shaving unit may be manually pushed off said tongue means.

5. The invention in accordance with claim 4 in which said tongue means is of a length substantially equal to the length of said slide coupling means of said shaving unit.

6. The invention in accordance with claim 1 in which said tongue means comprises a plurality of tongues forming a row of parallel tongues, an endmost tongue in said row being so oriented that an outermost shaving unit disposed on said endmost tongue has its slide coupling means facing an adjacent base portion.

7. The invention in accordance with claim 6 including a second base portion connected to said base portion and extending therefrom, said second base portion having second tongue means extending therefrom.

8. The invention in accordance with claim 1 including guide means attached to said tongue means for guiding a slide connection portion of said razor handle into engagement with said slide coupling means of said shaving unit disposed on said tongue means.

9. The invention in accordance with claim 8 in which said guide means comprise a shroud portion, an open end of said shroud portion being flared to guide said slide connection portion into registry with said slide coupling means.

* * * * *